United States Patent [19]

Schauber

[11] Patent Number: 4,610,494

[45] Date of Patent: Sep. 9, 1986

[54] FLEXIBLE SECURITY LOOP

[76] Inventor: Paul A. Schauber, 8302 Kendale Rd., Baltimore, Md. 21234

[21] Appl. No.: 674,089

[22] Filed: Nov. 23, 1984

[51] Int. Cl.[4] ..... H01R 13/639

[52] U.S. Cl. ..... 339/75 P; 339/103 R

[58] Field of Search ..... 339/75 P, 103 R, 119 C, 339/147 C

[56] References Cited

U.S. PATENT DOCUMENTS

| | | | |
|---|---|---|---|
| 1,665,095 | 4/1928 | Henry | 339/75 P |
| 2,720,633 | 10/1955 | Westberg | 339/75 P |
| 2,725,543 | 11/1955 | Tanner | 339/75 P |
| 3,387,254 | 6/1968 | Wheeler | 339/103 R |
| 3,475,716 | 10/1969 | Laig | 339/103 R |
| 3,781,761 | 12/1973 | Harwood | 339/75 P |
| 4,504,106 | 3/1985 | Fechter | 339/75 P |
| 4,514,026 | 4/1985 | Herbert | 339/103 R |

*Primary Examiner*—John McQuade

*Attorney, Agent, or Firm*—Kline, Rommel & Colbert

[57] ABSTRACT

A loop that can be easily attached to an electrical cord near the plug that will prevent accidental separation from said plug and another electrical cord plug when joined.

3 Claims, 9 Drawing Figures

FLEXIBLE SECURITY LOOP

BACKGROUND

My invention, the flexible security loop, relates in general to electrical utility tools and electrical extension cords, and a problem that still exists and can be solved easily with my flexible security loop.

Most electrical utility tools have a short electrical cord with a male plug and an extension cord must be used with them. When the female plug on the extension and the male plug on the utility tool cord are connected, it only takes a slight tug on either cord to accidently separate the connected plugs.

This has happened to most everyone who uses electrical utility tools, such as saws, drill motors, hedge trimmers, electrical grass movers, etc. with an electrical extension cord.

My flexible security loop can solve this problem easily, by simply attaching it to the utility tool electrical cord near the plug, then past the extension cord plug through the said flexible security loop and connect it to the said utility tool plug.

When either or both electrical cords are pulled on the pressure will be against the flexible security loop and the connection between the two plugs will remain together. The said flexible security loop or the electrical cords will break before the plugs will accidently separate.

SUMMARY

The flexible security loop can be attached to a utility tool electrical cord either before or after the plug is assembled to the end of the cord.

The flexible security loop can be attached to an electrical cord near plug by means of a slit between the loop and cord hole, simply by slipping the loop over the plug & pulling on loop until the flexible security loop snaps on electrical cord.

The flexible security loop can be installed on an electrical cord before the plug is attached to end of cord and the slit between the loop and cord hole can be omitted.

With the flexible security loop attached to the cord the extension cord can be easly connected to the utility plug, by passing the extension cord plug through the loop and connecting the two plugs together.

When either or both electrical cords are pulled on the force will be against the flexible security loop. The connection between the utility tool plug and the extension cord plugs will remain connected, either the flexible security loop or the electrical cords must break before the joined plugs will accidently separate.

The flexible security loop is simple and can be manufactured at low cost, can be installed in seconds to almost any electrical utility tool or extension cord and will eliminate a problem that most all users have with electrical utility tools and extension cords.

DETAILED DESCRIPTION OF THE INVENTION

Figure 1:
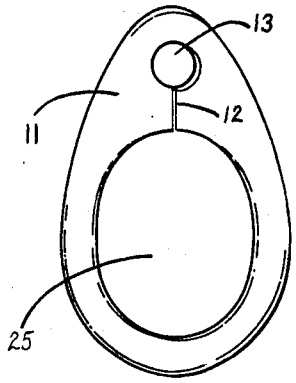
FIG. 1 Perspective view of flexible security loop with slot.
Figure 2:
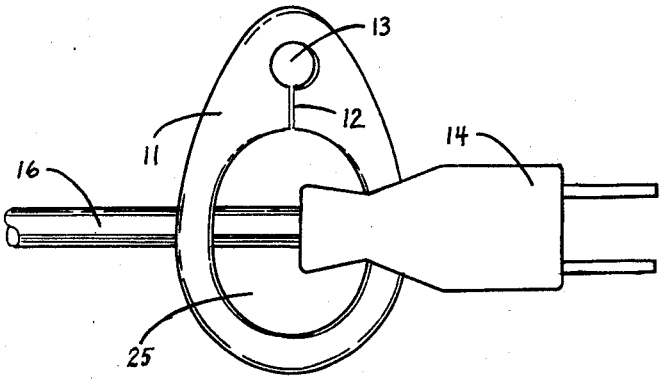
FIG. 2 Utility cord plug through flexible loop.
Figure 4:
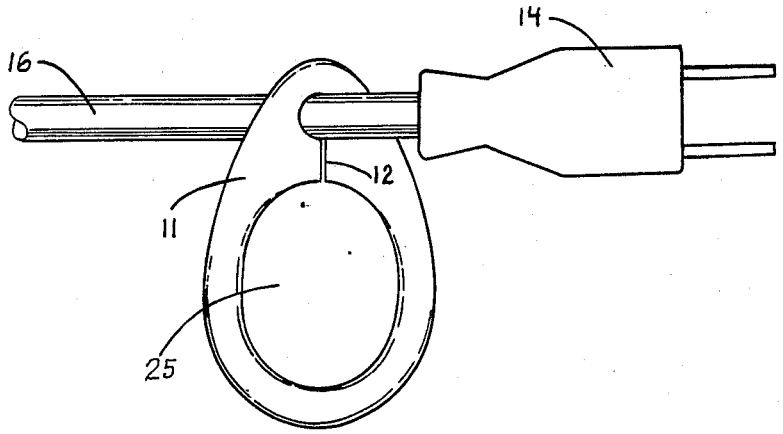
FIG. 4 Flexible security loop attached to utility cord.

Referring to drawing shown in FIG. 1, numeral 11 designates my invention, the flexible security loop, which is a semielliptical disk, which includes a large hole 25, and a small hole 13, and a narrow slot 12 connecting the said large hole 25 to the said small hole 13. The said small hole 13 is for attaching the loop, to an electrical cord. The said large hole 25 also shown in FIG. 2, allows the electrical cord 16, and plug 14 to pass through, far enough for attaching the flexible security loop 11 to the said electrical cord 16 near the said plug 14. FIG. 4 shows the flexible security loop attached to said electrical cord 16. To attach the loop to the electrical cord 16, just pull cord 16 against said slot 12. As pressure is applied the said slot 12 will spread open enough for the said electrical cord 16 to slip into the said small hole 13 and the said slot 12 will retract securing the flexible security loop 11 to the electrical cord 16.

Flexible security loop 11 thus comprises what may be aptly described as a retainer or yoke which includes holes 13 and 25 that define substantially coplanar cord receiving apertures, one of which, hole 13 shown herein, is smaller than the plug of the cord to be received therewithin.

Figure 3:
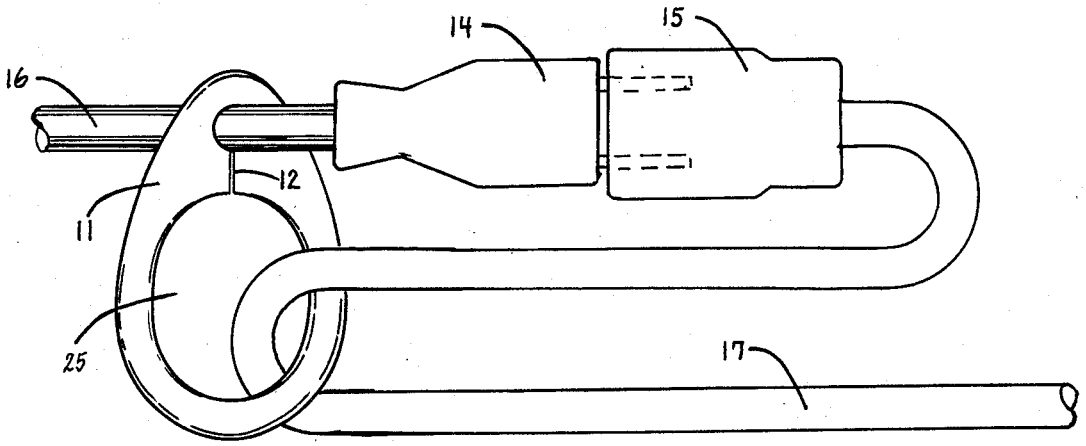
FIG. 3 Extension cord and utility cord connected and flexible security loop attached.

The manner of operable attachment of flexible security loop 11 to prevent accidental separation of connected electrical plugs is illustrated in FIG. 3. Plug 14 is passed through hole 25 and cord 16 slipped through slot 12 and into hole 13; and plug 15 is then passed through hole 25, from the same direction as was plug 14, and is then looped back toward flexible security loop 11 and is interconnected to plug 14. Thus, as shown in FIG. 3, in a relaxed state, in which neither of the cords are under any appreciable tension, cords 16 and 17 are trained through flexible security loop 11 in spaced apart substantially parallel axial relation to one another, with flexible security loop 11 attached about cord 16 adjacent plug 11 and with cord 17 being looped through flexible security loop 11 and looped back for interconnection of plug 15 to plug 14.

Figure 5:
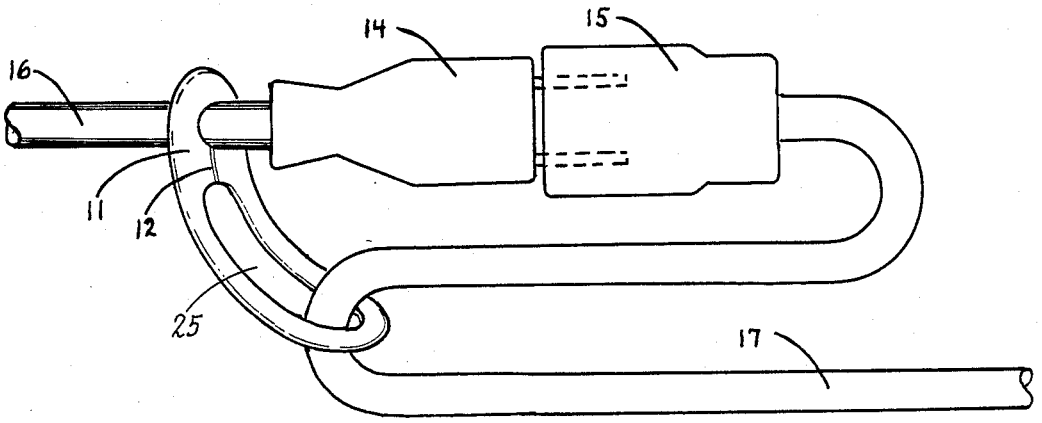
FIG. 5 Flexible security loop preventing separation of plugs under pressure.

FIG. 5 generally illustrates how flexible security loop 11 operates to prevent unwanted separation of the plugs. That is, when either or both cords 16 and 17 are pulled, flexible security loop 11 will be caused to elongate and, as the pulling force increases, flexible security loop 11 will slide along cord 16 and abut against plug 14. Any additional pulling force will be directionally reversed through the looped configuration of cord 17 in a manner such that the same tends to compress plug 15 together with plug 14 against flexible security loop 11.

Figure 6:
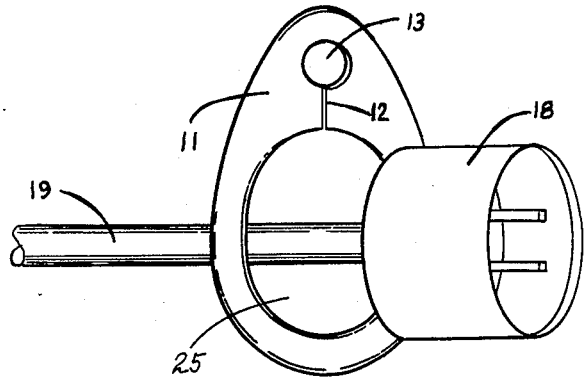
FIG. 6 Exterior type plug through flexible loop.

FIG. 6 shows an extertion type plug 18 and electrical cord 19 ready for attaching to the flexible security loop 11.

Figure 7:
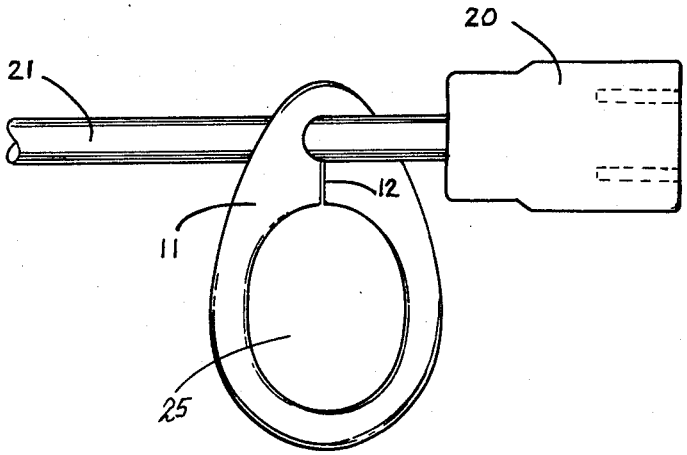
FIG. 7 Flexible security loop attached to an extension cord.

FIG. 7 shows the flexible security loop 11 attached to an extension cord 21 and plug 20.

Figure 8:
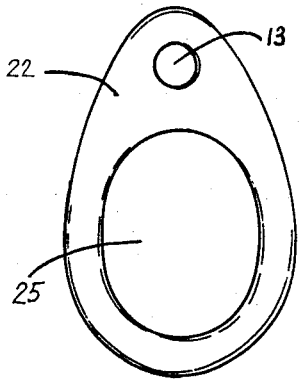
FIG. 8 Flexible security loop without slot.
Figure 9:
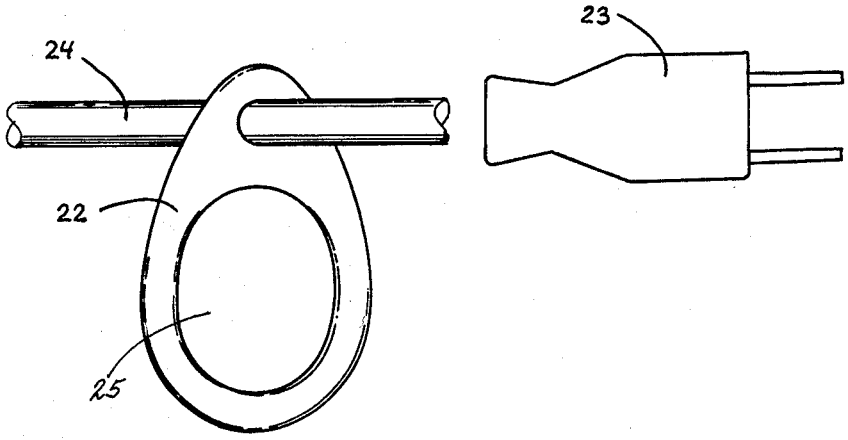
FIG. 9 Flexible security loop installed on electrical cord before plug installation.

FIG. 8 shows the flexible security loop 22 without slot between the large hole 25 and the small hole 13. This type can be installed on electrical cord 24, before the electrical plug 23 is installed on said electrical cord 24 as shown in FIG. 9

I claim:

1. For use in retaining a male plug of one electrical cord in mating relation to the female plug of another electrical cord against pulling forces on the cords that would normally tend to cause separation of the plugs, a flexible security loop having a pair of substantially coplanar cord receiving apertures, one of which is smaller than the other, the smaller of which is of a size to receive one electrical cord therewithin with the plug end adjacent one side of said flexible security loop and is smaller than the plug of the cord received therewithin, and the other of which receives the other cord therewithin and is of a size such that the plug of the cord to be received therewithin may be passed therethrough, the plug end of the cord to be received within the larger of said cord receiving apertures being entrained through the larger of said cord receiving apertures to the same side of said flexible security loop to which the plug end of the other electrical cord is adjacent and then looped back toward said flexible security loop for interconnection with the plug of the other cord.

2. A flexible security loop as specified in claim 1 wherein the larger of said cord receiving apertures is of a size such that each plug may be passed therethrough, an intercommunicating passageway being provided between said cord receiving apertures so that the plug and cord of the cord to be received within the smaller of said cord receiving apertures may be first entrained through the larger of said cord receiving apertures and the cord thereof then passed through said passageway to within the smaller of said cord receiving apertures.

3. For use in retaining a male plug of one electrical cord in mating relation to the female plug of another electrical cord against pulling forces on the cords that would normally tend to cause separation of the plugs, a flexible security loop having a pair of cord receiving apertures through which the cords may be respectively entrained with the plug ends of each in the same direction, one of said cord receiving apertures receiving one cord therewithin and being of a size smaller than the plug end of the cord received therewithin, and the plug end of the cord as entrained through the other of said cord receiving apertures being looped therefrom and back toward said flexible security loop and then interconnected to the plug of the other cord in juxtaposition so that pulling forces that would normally act on the electrical cords in a direction to separate the plugs causes abutment of said flexible security loop with the plug of the cord received within said cord receiving aperture that is of a size smaller than the plug end of the cord received therewithin and the loop of the cord as received within the other of said cord receiving apertures directionally reverses the pulling forces as exerted on such cord in a manner to compress the plugs together adjacent said flexible security loop.

* * * * *